US006547673B2

(12) United States Patent
Roark

(10) Patent No.: US 6,547,673 B2
(45) Date of Patent: Apr. 15, 2003

(54) INTERCHANGEABLE GOLF CLUB HEAD AND ADJUSTABLE HANDLE SYSTEM

(76) Inventor: Gary Roark, P.O. Box 120, Evans, WV (US) 25241

( * ) Notice: Subject to any disclaimer, the term of this patent is extended or adjusted under 35 U.S.C. 154(b) by 0 days.

(21) Appl. No.: 09/809,135

(22) Filed: Mar. 16, 2001

(65) Prior Publication Data

US 2001/0011042 A1 Aug. 2, 2001

Related U.S. Application Data

(63) Continuation-in-part of application No. 09/447,294, filed on Nov. 23, 1999, now abandoned.

(51) Int. Cl.[7] ..... A63B 53/02; A63B 53/16

(52) U.S. Cl. ..... 473/239; 473/288; 473/296; 473/299; 473/307

(58) Field of Search ..... 473/239, 307, 473/298, 299, 296, 288; 403/327, 328

(56) References Cited

U.S. PATENT DOCUMENTS 1,623,523 A * 4/1927 Bourke
1,946,134 A * 2/1934 Dyce
4,340,227 A * 7/1982 Dopkowski
4,852,782 A * 8/1989 Wu
5,722,901 A * 3/1998 Barron et al. ..... 473/305

* cited by examiner

*Primary Examiner*—Stephen Blau
(74) *Attorney, Agent, or Firm*—Merek, Blackmon & Voorhees, LLC

(57) ABSTRACT

A system for converting readily available standard off the shelf golf club parts into a interchangeable golf club system. A conversion system consists of a head insert which can be glued into the hosel of a standard golf club head. A shaft insert having a central flange is insertable and glueable into place on a standard shaft of a golf club. The shaft insert and the head insert forming a quick connect to attach the shaft to the golf club head. Through the use of different club heads representing the full range of woods, irons, and putter, each having a head insert pre-installed, the club may have emulating any club by attaching the desired club head. A shaft length adjustment is made by a cooperating pin installed in the top of the shaft and slidable within a number of slots provided in a telescoping sleeve slidable over the shaft.

4 Claims, 4 Drawing Sheets

INTERCHANGEABLE GOLF CLUB HEAD AND ADJUSTABLE HANDLE SYSTEM

This application is a continuation in part of application Ser. No. 09/447,294 filed Nov. 23, 1999, now abandoned entitled Interchangeable Golf Club Head and Adjustable Handle System which is hereby incorporated by reference.

BACKGROUND OF THE INVENTION

A. Field of the Invention

The present invention relates to a golf club system having interchangeable heads, adjustable length and a convenient case for carrying the clubs system about the body of the user.

B. Description of the Prior Art

The popularity of golf is currently at an all time high, and continues to show growth as more courses are being constructed across the country to meet the demand. However, the convenience of golf is relatively unchanged as few golf courses are located close to neighborhoods and downtown urban areas. And even when there is one golf course nearby, it is often the case that the course is either private and therefore unavailable to the golfer, or a different course is desired by the golfer for the sake of variety. It is therefore currently incumbent on the golfer to lug a heavy bag of clubs to the course in order to have the full range of golf clubs available to him during play, including the various woods, irons, putter, balls and various accessories. Often the golfer is a beginner, an elderly or handicapped user, or is unable to conveniently carry a full set of clubs to the course because of his physical limitations or other practical limitations.

Past efforts have been made to manufacture golf club kits or adjustable clubs to replace the standard golf club set.

U.S. Pat. No. 1,650,183 to Brooks shows a golf club having a selectively attachable head and handle for providing different loft heads for a single shaft. A threaded head and matching threaded shaft mate together to form a club.

U.S. Pat. No. 2,051,961 to Mears shows a golf club having a telescoping handle and a threadedly engaged head.

U.S. Pat. No. 3,524,646 shows a golf club assembly having a threadedly attached head and shaft for a putter.

U.S. Pat. No. 3,424,459 shows a golf club having an interchangeable golf club head.

U.S. Pat. No. 3,829,092 shows a carrying case for a multi-piece, telescoping golf club set.

U.S. Pat. No. 3,848,737 to Kenon shows a case for carrying multi-headed golf club and golf club accessories.

U.S. Pat. No. 3,891,212 to Hill shows a multi-part golf club and carrying case therefor. A threaded cuff on the handle threads on to mating threads on the head.

U.S. Pat. No. 4,253,666 to Murphy shows a case for a multi-part, disassemblable golf club which can be attached to the clothing or belt of the user.

However, none of the above inventions and patents, taken either singly or in combination, is seen to describe the instant invention as claimed.

SUMMARY OF THE INVENTION

The game of golf is played using a number of golf clubs from the putter to the irons to the woods and driver. Each club has its unique clubface loft and overall shaft length to provide a controllable trajectory of the ball flight, or more simply, to control the length that the ball travels in flight. On a typical hole of 320 plus yards, a golfer would normally hit the longest hitting club in his bag, namely a driver (the one wood) from the tee box to reduce the required distance to the hole on his second shot. The golfer would then approximate the distance left to the pin, and select an iron or fairway wood from his bag, which, in his golf experience, he has been successful hitting the needed distance. The golfer then hits one or more shots until he has successfully reached the green. The flat bladed putter is then used to roll the ball across the well manicured green into the hole concluding play on the particular hole. With golfers ranging from the professional caliber level to the beginner, the required number of strokes to successfully complete the hole might vary from three strokes (a "birdie") to ten or more. The number of different lofted clubs used during play on the hole might also vary from three clubs to eight or nine. By rule, a player can carry up to fourteen clubs in his bag to anticipate all of the different situations that he may find himself.

As can be imagined, the expense, weight and bulkiness of carrying fourteen clubs and all of the accessories necessary for the game of 18 holes can be daunting. But in order to effectively have the best chance of scoring well, players want to have their full compliment of clubs to make the already difficult game as easy as possible. Accordingly, it is a principal object of the invention to provide a golf club set which can be easily assembled and disassembled from a limited number of pieces to provide a compact and lightweight set of fully functional golf clubs capable of playing a complete round of golf.

It is another object of the invention to provide a portable golf club set which can be carried in a case wearable by a user.

It is a further object of the invention to provide a golf club set that can economically be made according to the method described herein using a standard, easily available golf club parts, including a non-threaded golf club head, for incorporation into an adjustable golf club.

Still another object of the invention is to provide a golf club and accessories set which is easier to transport and retains all the functionality of a standard golf club set.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(s)

Figure 1:
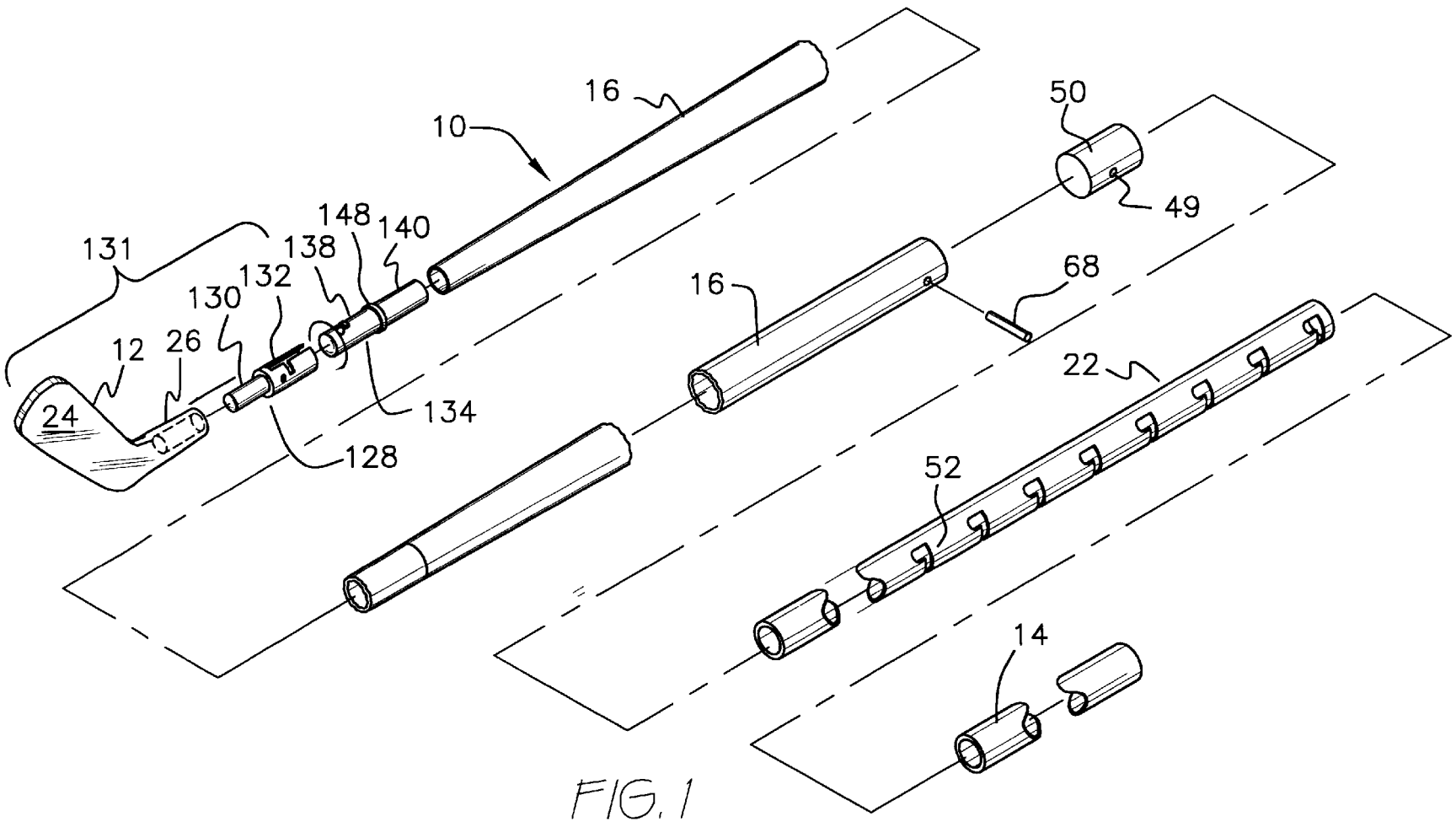
FIG. 1 is an exploded view of the parts of the golf system according to the present invention.

The present invention is to a compact golf set having the full functionality of a complete golf set in a compact, easily transportable configuration. As best shown with reference to the Figures, the set comprises a configurable golf club 10 (FIG. 1) having an interchangeable head 12, a telescoping handle 14, and an elongated shaft 16 connecting the handle 14 and the head 12. A convenient carrying case 18 (FIG. 5) carries spare heads (not shown) in pockets 20 as well as accessories (not shown) such as golf balls, tees, ball markers, and divot repair tools. The system incorporates all of the features of a standard golf club set while retaining a light and compact form making the game accessible to those who would have trouble transporting or carrying a normal set of clubs to a course.

Figure 5:
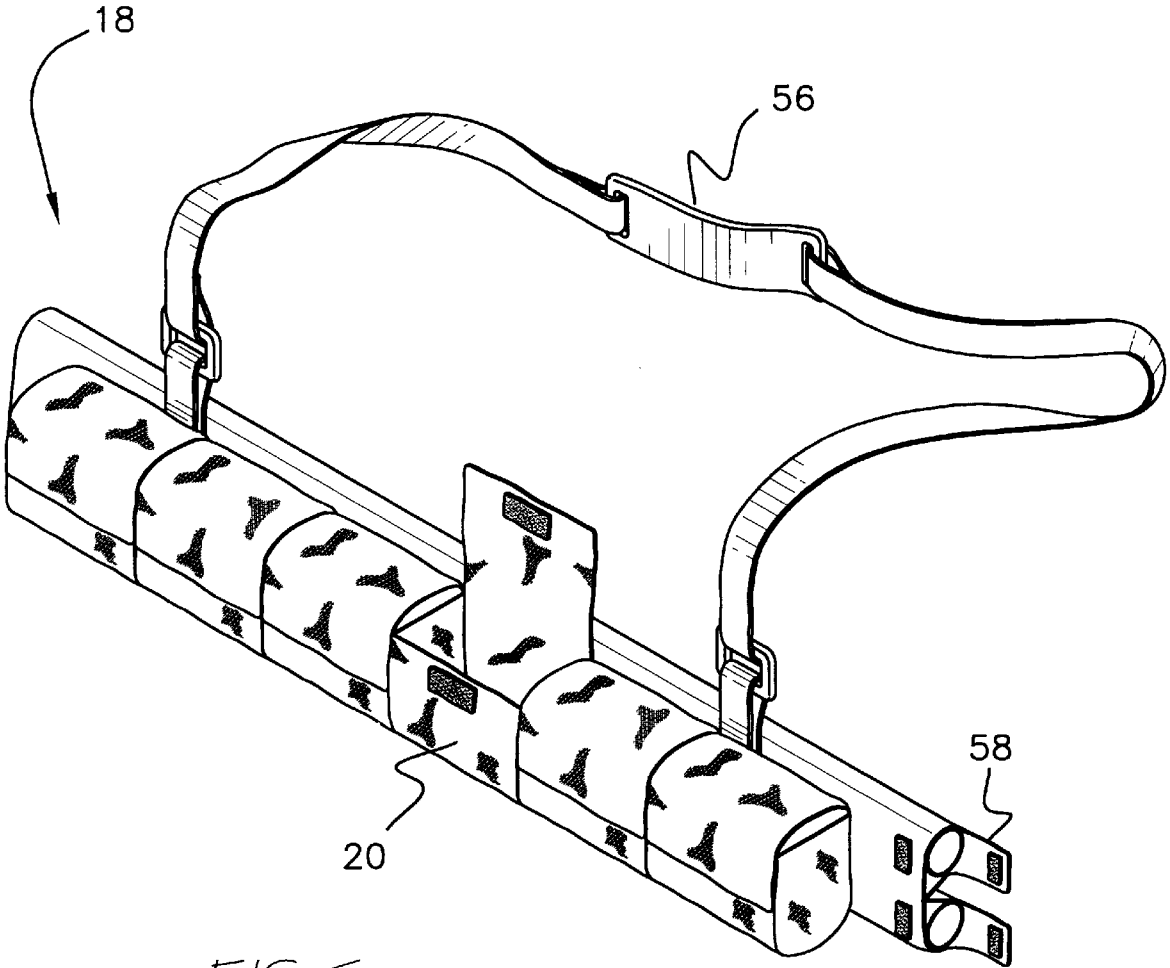
FIG. 5 is a perspective view of the carrying case of the golf club system.
Figure 7:
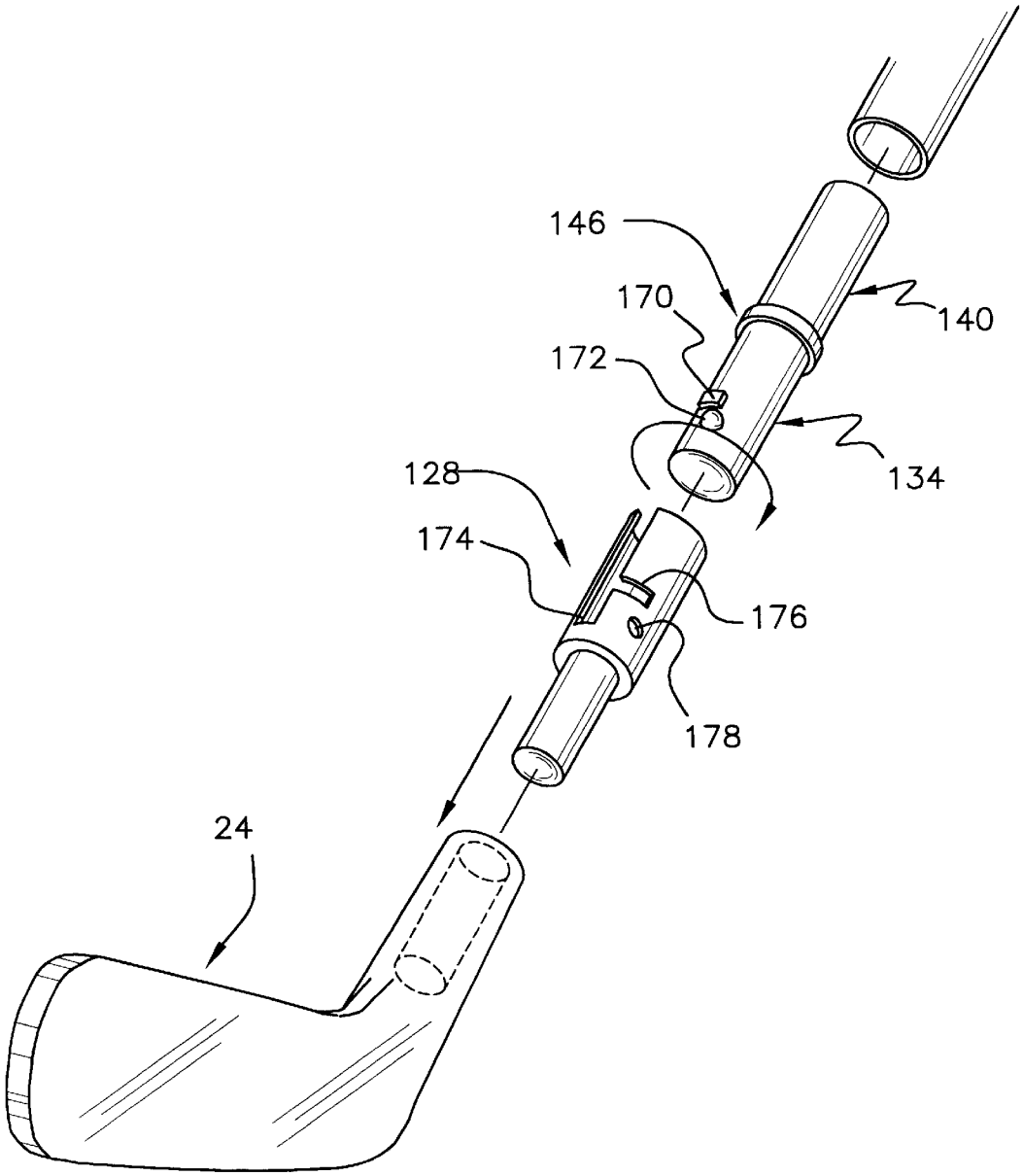
FIG. 7 is an perspective view of the golf club head and connectors.

Referring now to the club 10 shown in FIGS. 1 and 5, the individual head 12 can be replaced with a differently configured head 12 (i.e., different loft, etc.) so that the club can emulate any club normally carried in a full sized bag, including the putter, wedges, irons, woods, or driver. To further approximate the proper length of the emulated club, each club can be adjusted through a notched sleeve 22 connecting the shaft 16 to the handle 14.

The set may be formed using standard heads 12, shafts 16, and handles 14 available on the market. A unique interconnect system provides for the flexibility of the system while maintaining compatibility with components readily available in the market place.

Beginning with the golf club head 12, a standard head is used having a face 24 of particular shape, construction and loft depending on whether the club head is a putter, iron or wood. The heel of the club head is provided with a cylindrical hosel 26 extending upwardly and rearwardly therefrom. The hosel 26 has an inner chamber which normally receives the end of a golf club shaft within the hosel 26. The tapered shaft is normally inserted into the hosel until there is a tight fit between the shaft and hosel, and then the end of the shaft would be glued within the hosel to form the complete club. According to the present invention to make the club heads interchangeable, a two-piece, quick release connector is inserted between the shaft and the head to create an interchangeable club system.

The two-piece, quick release connector is formed by an upper connector 134 (shaft insert or shaft connector) and a lower connector 128 (head insert or head connector) that are shaped to secure together with a quickly releasably lock. The upper connector 134("shaft connector") is preferably made as a cylindrical rod, but may be tapered to mate more securely with the shaft 16 of the golf club. An upper end of the connector 140 is sized to fit within and secure to the interior of the shaft 16. An epoxy or adhesive non-rotatably secures the upper end 140 to the shaft 16. A flange 148 on the upper connector 134 provides a stop for the shaft to properly position the upper connector 134 within the shaft 16. A lower end 138 below the flange 148 has a pin 170 fixedly extending therefrom. A ball or catch 172 is biased to remain protruding outwardly from the lower end 138 of the connector by either the size of the housing or a spring or equivalent means. The ball is restricted in its outward travel by the size of the hole housing the ball being slightly smaller than the diameter of the ball in a manner well known in the art. The hole is sized such that the ball may retract within the hole well a force greater than the biasing spring force acts upon the ball.

The lower connector piece 128("head connector") has a lower end emulating the end of the golf shaft. This cylindrical section 130 may be tapered("frustoconical") in the same contour of a golf shaft so that it mates securely within the hosel 26 when fitted therein. An epoxy or other similar adhesive is used to non-rotatably secure the slotted connector to the golf club head to form an interchangeable head unit 131. The slotted connector has an upper portion 132 having a slot 174 having a vertical or axial opening 174 extending to the upper end of the connector and sized to receive pin 170 and ball 172. A circumferential slot 176 extends perpendicularly away from the axial slot and is sized to allow the pin 170 of the upper connector to move circumferentially along the circumferential slot 176. A hole 178 is also provided in the upper portion of the lower connector sized and positioned to receive the ball 172 when the pin 170 is at the terminal end of the circumferential slot 176.

When the head connector 128 is affixed to the golf club head 24 and the shaft connector 134 is affixed to the shaft 16, the system is ready for use. In practice, each golf club head 24 would be connected to a different lower connector 128 before starting a round of golf, so that each can be readily attached to the upper connector as described below.

When a player ("golfer") has decided which club he wants to use, he selects a golf club head having the proper loft for the desired shot, such as a "driver" for teeing off. The driver head 24 has a head connector 128 attached to the club head for ready attachment to the golf shaft 16 which has a shaft connector 134 connected. Holding the golf club in one hand, the golfer (not shown) aligns pin 170 of the shaft connector 134 with the slot 174 of the head connector 128. The pin 170 and ball 172 is then slid along the slot 174 until preferably the flange 148 of the shaft connector abuts the top of the upper portion 132 of the head connector 128. The shaft and connector are then rotated 90 degrees to engage the connector ball spring and pin into the club head mating slot and holes, respectively. The ball or catch can be pressed down manually to facilitate turning or the force of the turning will automatically cause the ball 172 to retract. The force of the head and shaft connectors sliding together will cause ball 172 to retract within its housing allowing the connectors to continue to slide together until fully mated. 170, 172 are in align both slide together in slot 174—spring ball 172 is depressed, 128 rotates 90 degrees to engage slot 174 and 178.

Preferably, when the flange 148 is touching the head connector 128, pin 170 should align with circumferential slot 176. By rotating the shaft connector 134 relative to the head connector, the pin 174 can be forced to travel along the length of the circumferential slot 176. When the pin reaches the end of the slot, the ball 172 will align with the ball hole 178 allowing the ball to protrude at least partially through the ball hole 178. The spring force acting on the ball will cause the ball to act as a lock against unwanted relative rotational movement between the head connector 128 and the shaft connector 134. This is extremely important to keeping the face of the head 24 properly aligned with the desired target area of the golf shot. Any rotation from the desire plane will cause undesirable spin on the ball as the golfer swings the club causing the ball to "slice" or to "hook," meaning that the ball will veer off to one side or the other of the desire ball flight path. While the ball prevents relative rotational movement, the pin 170 in slot 176 likewise prevents relative axial motion between the head connector 128 and the shaft connector 134. The pin also helps maintain the ball properly in the hole 178.

To release the club, the golfer simply grabs the golf head 24 securely in one hand and the shaft 16 in the other and turns the shaft relative to the head to provide enough force to cause the ball to retract in its housing as the pin travels along the slot 176. If desired, it may also be necessary to manual push the ball down as the shaft is turned to provide the necessary force to retract the ball, if the spring force biasing against the ball is sufficiently strong. Once the ball has retracted, it is a simple matter to rotate the shaft in the reverse direction to force the pin along slot back into slot 174 where the shaft connector can be removed axially from the head connector. With the head removed from the shaft, a different head can be pulled from the pocket 20 of the carrier 18 to prepare for a different shot. This quick connection system allows for the use of one shaft with a number of diverse club heads 24 to simulate a full set of clubs.

Because each club head in the set has a head insert installed into the club head, replacement is a fast and simple matter. Thus a three-iron club head 12 (with insert attached) could be quickly replaced by a nine iron club head 12. The unused interchangeable head unit 131 can then be stored in a pocket 20 (FIG. 5) for use at a later time.

Importantly, the ball lock of the quick connect system provides a solid, reliable connection between the shaft and head to create the same one-piece "feel" of a standard golf club. This is one of the key improvements that allows the use of a standard golf club head in the interchangeable golf club system.

Figure 4:
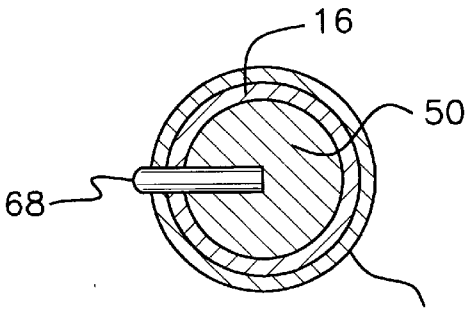
FIG. 4 is a cross-sectional view of the golf club handle connection system drawn along line 4—4 of FIG. 2.
Figure 3:
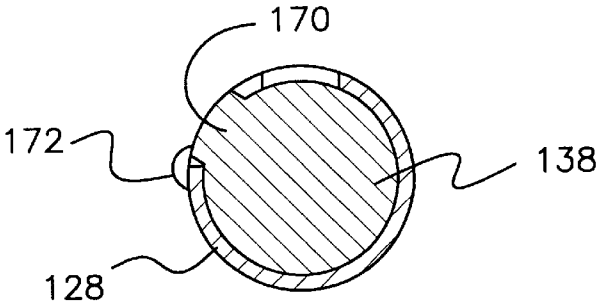
FIG. 3 is a cross-sectional view of the golf club head connection drawn along line 3—3 of FIG. 2.
Figure 2:
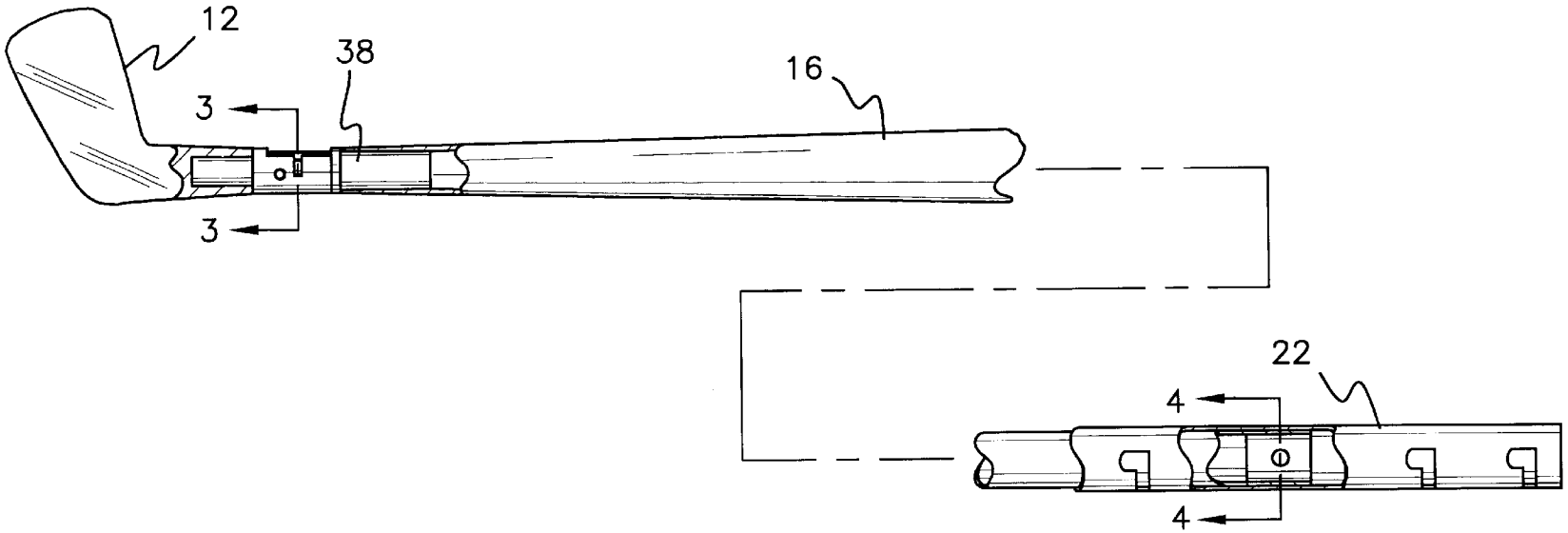
FIG. 2 is a partial breakout view of the golf club showing the connection of the portions of the golf club system.
Figure 6:
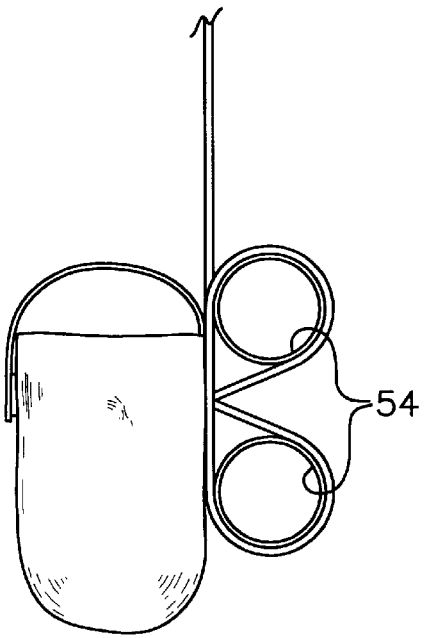
FIG. 6 is a side elevational view of the carrying case of the golf club system.

While the club set would be workable and considered complete at this point, to achieve a more realistic "feel" of a standard golf club, it is desirable to alter the length of each emulation mode of the club to the length that a one piece club would have. In a normal set of clubs, the higher number clubs are generally shorter than the smaller number clubs, allowing greater torque and swing arcs to be applied to the longer clubs to achieve longer distances. The length adjustment is carried out in the present invention by the use of a notched sleeve 22 as shown in FIGS. 1, 2 and 4.

At an upper end of the shaft 16 a hole 49 has been provided for receiving a lock pin 68. A stop 50 is mounted and affixed within the upper end of the shaft 16 to receive the end of the pin 68. The pin may be held and secured in the stop 50 by interference fin, polymeric expander, flanges, springs loading threadedly engaged or other commonly known means.

A telescoping sleeve 22 sized to slide about the shaft is provided with a series of notches 52 defined on the sleeve outer wall to receive the pin 68. The notches may all be interconnected or separate from each other, depending on whether the selected pin is retractable within the shaft or fixed in position to promote relative motion of the shaft and the telescoping sleeve 22. When it is desired to increase or decrease the length of the shaft, the pin 68 is moved into engagement with a different slot 52 of the telescoping sleeve, thereby adjusting the relative length of the club head 12 to a handle portion 14 at the top of the sleeve. To further promote ease of use of the club a rubber grip (not shown) may be affixed to the top of the handle to accommodate the hands of the golfer.

When play is done, the golf club can be disassembled for easy transport. As shown in FIGS. 1 and 5, the interchangeable head unit 131 can be removed from the club by disengaging the quick disconnect of the head insert 128 from the shaft insert as described above. The interchangeable head unit 131 can then be stored in one of the pockets 20. The shaft and insert can then either be removed from each other or slid together such that the two portions substantially overlie each other and slid within the receiving chambers 54. The case can then be secured over the shoulder by strap 56 or fastened about the waist of the user by belt 58. Of course with the shaft and telescoping sleeve inserted into the pack, it may typically be more convenient to use the shoulder strap when shaft is carried within the case. A spare shaft could also be stored within the case with a shaft insert installed in case the main shaft breaks during play.

One of the key elements to the current invention is that industry standard golf components can be converted into the interchangeable golf club system of the current invention through the use of the head connector and shaft connector (the "conversion system"). A standard golf club has a head 12 glued to the end of a shaft 16 with a grip affixed to the end of the shaft. The current invention modifies a standard golf club by affixing a head connector 128 into the hosel 26 of the head 12. A shaft connector 134 is affixed into the shaft 16. By sliding the shaft connector onto the head connector and rotating until the ball locks the connectors in place, a complete golf club is formed. The length adjustment option can then be installed by adding the stop 50, pin 68 and telescoping sleeve 22 as described above, an adjustable length club is formed. Only a hole drilled into the shaft is necessary to convert to the adjustable length club.

It is to be understood that the present invention is not limited to the sole embodiment described above, but encompasses any and all embodiments within the scope of the following claims.

I claim:

1. A conversion system for converting a golf club having a club head, means defining a non-threaded socket within said club head for receiving a shaft, and a shaft, into an interchangeable club system, comprising:

a quick connect head insert for inserting into the socket of the club head;

a quick connect shaft insert adapted to cooperate with said head insert for inserting into the shaft of a golf club;

said shaft insert including a pin projecting radially outward from said head insert;

said head insert having means defining an axial slot extending axially along a portion of said head insert, and a second means defining a circumferential slot extending circumferentially from said axial slot; whereby said club head is connected to said shaft by sliding said shaft insert pin along said axially slot and rotating said shaft insert to move said pin along said circumferential slot; and said shaft insert further including a spring biased catch projecting radially outwardly from said shaft insert and means defining a hole in said head insert for receiving said spring biased catch to selective non-rotatably lock said shaft insert to said head insert;

whereby when said head insert is affixed within the socket of the golf club head and said shaft insert is affixed within the shaft, the golf club head can be selectively quickly connected to the shaft by quick connecting said head insert to said shaft insert to form a complete golf club.

2. The conversion system of claim 1, further including a telescoping shaft.

3. A method of converting a golf club into an interchangeable club system, consisting of the steps of:

a) providing a shaft and a golf head having means defining a non-threaded hosel therein;

b) providing a first insert having means defining a slot and having means separate from said slot defining a hole on an outer surface of said first insert;

c) providing a second insert having a pin for cooperating with said slot to guide said first insert onto said second insert and a ball for cooperating with said hole for locking said first insert onto said second insert; and d) affixing one of said first insert or said second insert onto said shaft and affixing the other one of said first insert or said second insert onto said golf head;

e) connecting said first insert to said second insert to form a complete golf club.

4. The method of converting golf clubs according to claim 3, further comprising the steps of:

a) providing means defining a hole in said shaft at an upper end thereof;

b) providing a stop sized to fit on said upper end of said shaft;

c) providing a pin cooperating with said stop and sized to fit within said hole on said shaft;

d) inserting said pin through said hole in said shaft and into said stop to secure said stop non-slidingly within said shaft;

e) providing a telescoping sleeve having a plurality of slots and sized to fit slidingly on said shaft;

sliding said telescoping sleeve over said shaft and inserting said pin into one of said plurality of slots to selectively, non-slidingly secure said telescoping sleeve on said shaft.

* * * * *